US006514111B2

(12) United States Patent
Ebihara et al.

(10) Patent No.: US 6,514,111 B2
(45) Date of Patent: Feb. 4, 2003

(54) PLASMA DISPLAY PANEL HAVING A DIELECTRIC LAYER OF A REDUCED THICKNESS IN A SEALING PORTION

(75) Inventors: Kazumi Ebihara, Miyazaki (JP); Yoshinori Osaka, Miyazaki (JP); Kenji Horio, Kobe (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/123,205

(22) Filed: Apr. 17, 2002

(65) Prior Publication Data

US 2002/0111102 A1 Aug. 15, 2002

Related U.S. Application Data

(62) Division of application No. 09/289,583, filed on Apr. 12, 1999, now abandoned.

(30) Foreign Application Priority Data

Jul. 9, 1998 (JP) ..... 10-194556

(51) Int. Cl.[7] ..... H01J 9/26
(52) U.S. Cl. ..... 445/25; 313/586
(58) Field of Search ..... 445/24, 25; 313/586

(56) References Cited

U.S. PATENT DOCUMENTS

| | | | | | |
|---|---|---|---|---|---|
| 3,962,597 | A | * | 6/1976 | Clark et al. | 313/318.01 |
| 3,998,510 | A | * | 12/1976 | Salisbury | 313/586 |
| 4,423,356 | A | * | 12/1983 | Sato et al. | 313/582 |
| 5,952,782 | A | * | 9/1999 | Nanto et al. | 313/582 |
| 6,004,179 | A | * | 12/1999 | Alwan | 445/24 |
| 6,084,349 | A | * | 7/2000 | Ueoka et al. | 313/112 |

* cited by examiner

*Primary Examiner*—Kenneth J. Ramsey
(74) *Attorney, Agent, or Firm*—Staas & Halsey LLP

(57) ABSTRACT

The present invention provides an AC memory type plasma display panel comprising a pair of substrates and stacked together via a sealing member so as to have a discharge space therebetween, and discharge electrodes and a dielectric layer covering the discharge space therebetween, and discharge electrodes and a dielectric layer covering the discharge electrodes formed on at least one of the substrates. The dielectric layer is formed on the surface of the substrate including a display region and a portion outside the display region in which the sealing member is located. The thickness of the portion for bonding of the sealing member outside the display region is smaller than the thickness of the portion corresponding to the display region.

17 Claims, 8 Drawing Sheets

PLASMA DISPLAY PANEL HAVING A DIELECTRIC LAYER OF A REDUCED THICKNESS IN A SEALING PORTION

This application is a divisional application of application Ser. No. 09/289,583 filed Apr. 12, 1999, now abandoned.

BACKGROUND OF THE INVENTION

1. Field of the Invention

This invention relates in general to a plasma display panel, and more particularly to an AC memory type plasma display panel and a method for fabricating the same.

2. Description of the Related Art

An AC memory type plasma display panel (hereinafter abbreviated as "PDP") is provided so that a dielectric layer for storing an electric charge resulting from a discharge covers a discharge electrode. In this PDP, a damage to the dielectric layer may cause leakage of a discharge gas, and particularly, a damage to the dielectric layer at a sealing section is fatal. A sealing structure and a sealing method not damaging the dielectric layer is therefore demanded.

As a typical example of PDP, a PDP of three-electrode lateral discharge structure is illustrated in FIG. 6 and will briefly be described.

FIG. 6 is a perspective view of a partially cut PDP. In FIG. 6, main electrodes (display electrodes) X and Y in pair for generating lateral discharge are arranged in parallel to each other with one pair for each matrix display line L on the inner surface of a front glass substrate 40. Each of the display electrode pairs X and Y comprises a transparent electrode 42 and a bus electrode 43, and is covered with a dielectric layer 44 for AC driving. A protecting layer 45 comprising magnesium oxide (MgO) is provided on the surface of the dielectric layer 44.

Address electrodes 46 for generating an address discharge are, on the other hand, arranged in parallel to each other and across the display electrode on the inner surface of a back glass substrate 41. A dielectric layer 47 is formed on the back glass substrate 41 covering over the address electrode 46, and a stripe-shaped barrier 48 having a height of about 150 $\mu$m as a spacer between the both substrates is provided on the surface of the dielectric layer with each of the address electrodes 46 in between. A discharge space 49 is partitioned by an adjacent pair of the barriers 48 into sub-pixels (unit light emitting areas) and regulates the size of intervals of the discharge space. Fluorescent members 50 of three colors including R (red), G (green) and B (blue) for full color display are provided in the long and thin gaps between the barriers 48 so as to cover the side walls of the barrier and the surface of the dielectric layer 47.

The front glass substrate 40 and the back glass substrate 41 are separately formed, and finally stacked together by means of a sealing member so as to provide a discharge space 49 in between. A discharge gas (for example, a mixed gas of neon and xenon) exciting the fluorescent members 50 under a pressure of about several hundred of Torr by irradiating ultraviolet rays upon discharging.

FIGS. 7A and 7B are sectional views illustrating the stacking process of a front glass substrate 52 and a back glass substrate 57.

FIGS. 7A and 7B represent the states before and after stacking, respectively. A sealing member 62 for sealing peripheries of the both substrates is previously formed on a dielectric layer 59 on the back substrate 57 as shown in FIG. 7A, and then is aligned to the periphery of the opposing dielectric layer 54 on the front substrate 52.

More specifically, the sealing member 62 is formed by coating a low-melting-point glass paste by screen printing into a frame shape on the dielectric layer 59 of the back substrate 57 on which the address electrodes 58, the dielectric layer 59, the barriers 60 and the fluorescent members 61 are already formed, and then applying a heat treatment (baking). The sealing member 62 before baking is configured so as to be slightly higher than the barrier 60 to press the opposing dielectric layer 54 on the front substrate 52.

The peripheral portion 54*a* outside the display region of the dielectric layer 54 on the front substrate 52 is not covered with the protecting layer 56, and a bonding portion of the sealing member 62 is formed so as to be aligned with this peripheral portion not covered with the protecting layer.

After stacking the glass substrate 52 on top of the glass substrate 57 as shown by arrows, pressure is applied to the glass substrates with heat-treatment, consequently, the sealing member 62 softens to bond the substrates 52 and 59 together to complete sealing. FIG. 7B shows the sealed state.

The sealing member 62 is formed between the dielectric layers 54 and 59 of the respective substrates 52 and 57 in order to achieve a high sealing property. More specifically, the dielectric layers 54 and 59 can improve adhesivity because of their fusibility with the sealing member 62, comprising a low-melting-point glass. The dielectric layers 54 and 59 also can ensure flatness by absorbing the surface irregularities on the substrates generated by the display electrode 53 and the address electrode 58. A synergetic action of these effects makes it possible to achieve a highly accurate sealing.

After sealing the both glass substrates 52 and 57 as described above, the discharge space is evacuated and cleaned, and then a discharge gas is sealed in to complete the PDP.

FIG. 8 is a sectional view for explaining the problems involved in the conventional art, with an enlarged sealed portion: the same components as in FIG. 7B are assigned the same reference numerals.

The sealing member 62 is formed, as described above, by coating a low-melting-point glass paste and baking the same. After baking, the top portion (leading end portion) becomes a solid body having a rounded shape under the effect of surface tension.

The dielectric layer 54 on the front substrate with which the sealing member 62 comes into contact must have a thickness of several tens of $\mu$m to permit storage of the electric charge resulting from discharge for AC driving.

Upon stacking the both glass substrates, therefore, force is concentrated on the leading end portion of the sealing member 62, and fine flaws may be produced in the dielectric layer 54 on the front glass substrate, at locations corresponding to the leading end portion. Heat treatment in this state produces a stress in the dielectric layer 54 caused by a difference in respective thermal expansion coefficients of the dielectric layer 54 and the front glass substrate 52. This causes production of cracks from fine flaws previously produced in the dielectric layer 54, thus posing a problem of formation of a damaged portion 54*a* as shown in FIG. 8. Since large thickness leads to a large stress produced in the dielectric layer, the risk of crack occurrence becomes higher when the dielectric layer is made thicker to achieve a lower power consumption for AC driving.

Because the discharge gas 63 is sealed-under a predetermined pressure in the discharge space 49 sealed with the sealing member 62, a damage to sealing property caused by the damaged portion 54*a* would result in leakage of the discharge gas as shown by the arrows. Leakage of the discharge gas 63 causes deterioration of discharge property with time, thus resulting in a fatal defect of the PDP.

Even when roundness of the leading end of the sealing member 62 is ground off, a force is concentrated on the contact portion of the sealing member 62 and the dielectric layer 54, thus resulting in similar problems.

SUMMARY OF THE INVENTION

One aspect of the present invention comprises a plasma display panel having a pair of opposing flat glass panels sealed air-tightly with each other in the peripheral region by a sealing member with a discharging space between the opposing surfaces of the pair of glass panels. At least one of the opposing surfaces has a discharging electrode in the display region thereon. Each of the opposing surfaces of the flat glass panels is coated with a respective dielectric layer with which the sealing member is in contact. The dielectric layer in the sealing portion of the flat glass panel having the discharging electrode is thinner than that in the display region.

In another aspect of the present invention, the dielectric layers on the opposing glass panels differ in thickness from each other. The opposing glass panels are sealed in their respective peripheral regions, such that the sealing member connects the dielectric layers having different thicknesses together.

In a further aspect of the present invention, the sealing member is first formed on the dielectric layer coated over the surface of the flat glass panel having the discharging electrode, and then aligned to the opposing glass panel having the thinner dielectric layer thereon such that the sealing portions of the both glass panels coincide with each other. Subsequently, the sealing member is heated to be softened with proper pressure and then cooled down such that the glass panels are air-tightly sealed to each other with the discharge space between the opposing surfaces.

One advantage of the invention is that the stress in the dielectric layer of the sealing region is reduced, thereby the occurrence of flaws therein is avoided without reducing the thickness of the dielectric layer in the display region which is needed for low power driving of the AC memory type plasma display panel.

BRIEF DESCRIPTION OF THE DRAWINGS

The present invention will be more apparent from the following description, when taken to conjunction with the accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that they are not intended to limit the invention to these embodiments. On the contrary, the invention is intended to cover alternatives, modifications and equivalents, which may be included within the spirit and scope of the invention as defined by the appended claims.

Figure 1:
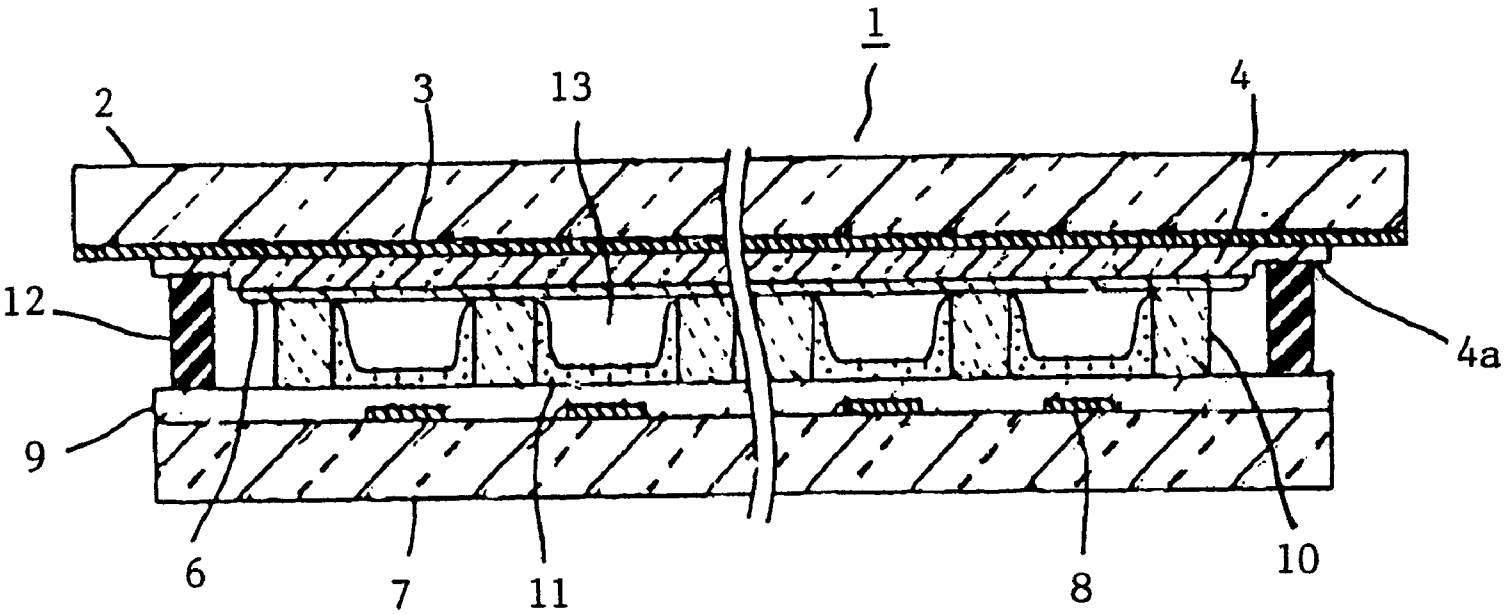
FIG. 1 is a sectional view for explaining an embodiment of the PDP of the present invention.

FIG. 1 is a sectional view for explaining a PDP of the three-electrode lateral discharge structure in the first embodiment of the invention.

In the PDP 1 of this embodiment, display electrodes 3 (X and Y) arranged as a pair for lateral discharge are arranged on a front glass substrate 2; address electrodes 8 are arranged on a back glass substrate 7; and the peripheries of the substrates 2 and 7 are sealed with a sealing member 12 so as to have a discharge space 13 between the pair of substrates 2 and 7.

Each of the display electrodes 3, arranged in pairs on the front glass substrate 2, comprises a wide transparent conductive layer and a narrow metal layer. The display electrodes 3 extend in parallel to each other with a lateral discharge gap in between so as to lead an end out to serve as a terminal near the peripheries of the substrates. A dielectric layer 4 comprising a low-melting-point glass mainly containing lead oxide (PbO) for AC driving is formed on the front glass substrate 2 so as to cover the center portion of the display electrodes 3, excluding the opposite ends thereof, serving as terminals for the display electrodes 3.

In accordance with one of the features of the present invention, the center portion of the dielectric layer 4 corresponding to the display region is formed in a first thickness, and the peripheral portion 4*a* thereof serving as a bonding portion of the sealing member is formed in a second, relatively smaller thickness. More specifically, the center portion of the dielectric layer 4 corresponding to the display region must have a thickness of several tens $\mu$m, permitting storage of charges resulting from discharge for AC driving causing continuous occurrence of lateral discharge by the pair of display electrodes. In order to achieve a low power consumption in addition to this, it is necessary to provide a thickness as large as about 40 $\mu$m. That is, a large thickness of the dielectric layer permits reduction of the electrostatic capacity between the display electrodes, so that the power consumption for charging the electrostatic capacity upon lateral discharge becomes smaller, thus achieving a lower power consumption. For the dielectric layer 4 in this embodiment, therefore, the portion corresponding to the display region has thickness of 40 $\mu$m.

The thin portion 4*a* serving as the bonding portion of the sealing member of the dielectric layer 4 is, on the other hand, outside the display region. It is, therefore, not necessary to have such a charge storage function. This portion is therefore set to thickness of about 20 $\mu$m, half that of the display region. In short, the thickness of this thin portion 4*a* is selected within a thickness range in which it is possible to prevent damage to the dielectric layer caused by the contact (adhesion) of the sealing member 12 and to ensure flatness by absorbing surface irregularities of the substrate due to the display electrodes.

A protecting layer 6 comprising magnesium oxide (MgO) covers the portion of the dielectric layer 4 corresponding to the display region.

The address electrodes 8 on the back substrate 7, on the other hand, are arranged so as to cross the display electrodes 3. In this address electrode 8, as well, the center portion, excluding the opposite ends serving as terminals, is covered with the dielectric layer 9. This dielectric layer 9 has, however, a uniform thickness of about 10 μm as a whole, and comprises a white material such as a low-melting-point glass mainly comprising zinc oxide (ZnO) containing trace titanium oxide, reflecting the discharge light for improving the display luminance. This dielectric layer 9 is provided with a view to preventing damage to the surface of the back glass substrate 7 caused by an excessive cutting upon sandblast fabrication of the barrier, as described later, and absorbing surface irregularities of the back glass substrate serving as the bonding surface of the sealing member 12 caused by the address electrode 8.

A barrier 10 having a plurality of stripes is formed on the portion of the dielectric layer 9 corresponding to the display region for partitioning the light emitting area, with an address electrode 8 between each pair of adjacent barriers 10. Red, blue and green fluorescent members 11 are repeatedly formed in respective light emitting areas thus partitioned so as to cover the sides of the barrier and the dielectric layer including the upper portion of the address electrode. A continuous frame-shaped sealing member 12 comprising a low-melting-point glass is provided on the periphery of the dielectric layer 9.

The front glass substrate 2 and the back glass substrate 7 are stacked with each other, and the peripheries thereof are sealed by the sealing member 12.

Upon sealing, the sealing member 12 is positioned between the dielectric layers 4 and 9 of the both glass substrates 2 and 7, and is in adhering contact with the dielectric layer 4 on the front glass substrate 2 at the thin portion 4*a*. In the thin portion 4*a*, having a small thickness, therefore, the stress caused by the difference in thermal expansion coefficient from the front glass substrate upon backing of the sealing member 12 is small. As a result, even when a fine flaw is produced in the thin portion by the contact with the sealing member, there is only the slightest risk of occurrence of cracks propagating from such a flaw. Data regarding the occurrence rate of cracks will be described later.

This sealing forms a discharge space, and a mixed gas of neon and xenon serving as a discharge gas is sealed in this discharge space under a pressure of about several hundred of Torr, thus completing a PDP.

For the purpose of determining optimum thickness of the portion of the dielectric layer 4 in contact with the sealing member 12, the present inventors prepared a plurality of PDPs having dielectric layers of different respective thicknesses (by the fabrication method described later), and investigated the occurrence rate of cracks. The result of investigation will now be described with reference to FIG. 4.

Figure 4:
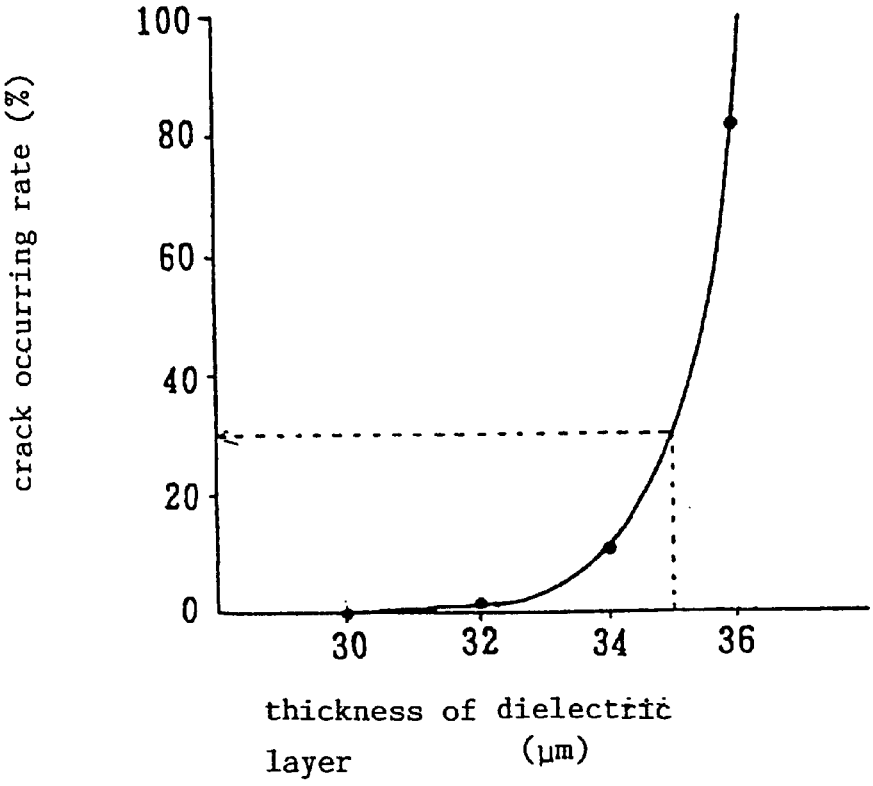
FIG. 4 is a graph illustrating the crack occurring rate vs. thickness of a dielectric layer.

FIG. 4 is a graph illustrating the relationship between the dielectric layer thickness and the crack occurring rate in a PDP having an aspect ratio of 16:9 and a diagonal size of 42 inches: about 100 panels for each thickness were investigated.

In this investigation, the crack occurring rate was determined on dielectric layers formed with a difference in thickness by 2 μm within a range of from 30 to 36 μm. As a result, a thickness of 30 μm resulted in no crack, and the crack occurring rate was about 1% for 32 μm, about 10% for 34 μm, and about 80% for 36 μm.

The results indicate that, since a thickness, of the portion of the dielectric layer in contact with the sealing member, of over 35 μm leads to a sudden increase in the crack occurring rate, the thickness of the portion of the dielectric layer in contact with the sealing member should preferably be up to 35 μm. The crack occurring rate for thickness of 35 μm is conjectured to be about 30% from the graph of FIG. 4.

The lower limit value of thickness of the dielectric layer should preferably be one permitting absorption of surface irregularities of the substrate caused by the electrodes. Since the electrodes have thickness of about 2 μm, a thickness of the dielectric layer of 5 μm enables to ensure a satisfactory adhesion to the sealing member by absorbing surface irregularities caused by the electrodes.

From these results, the thickness of the portion of the dielectric layer in contact with the sealing member should preferably be within a range of from 5 to 35 μm. This range may somewhat vary with different aspect ratios or sizes.

The fabrication method of a PDP in the aforementioned embodiment will now be described with reference to FIGS. 2A through 2C.

Figure 2A:
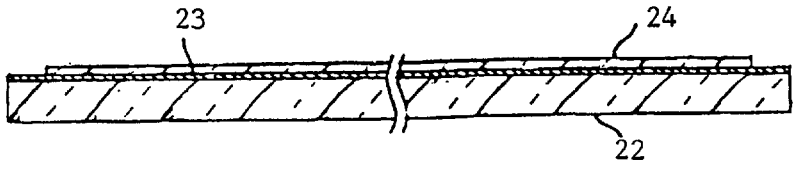
FIGS. 2A through 2C are sectional views for explaining the first embodiment of the PDP fabrication method of the invention.
Figure 2B:
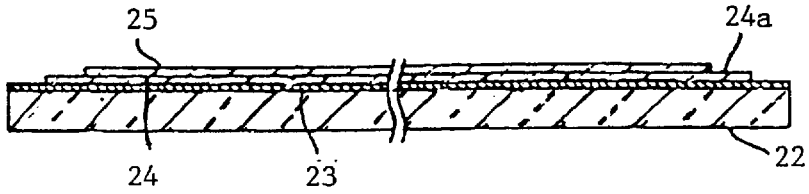
Figure 2C:
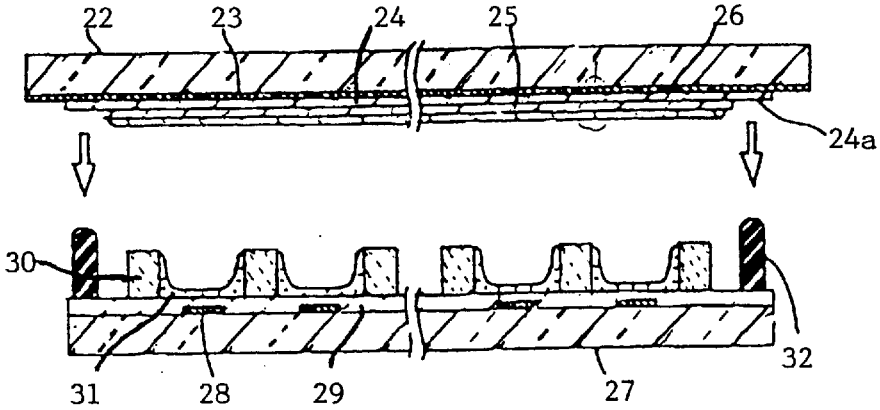

FIGS. 2A through 2C are sectional views for explaining a first embodiment of the PDP fabrication method: FIGS. 2A and 2B illustrate the fabrication steps of a front substrate, and FIG. 2C, stacking steps of the front substrate and the back substrate.

First, the fabrication steps of the front substrate will be described.

As shown in FIG. 2A, a plurality of pairs of stripe-shaped display electrodes 23 are formed by the photolithographic process on a glass substrate 22 serving as a base material for the front substrate. Each of these display electrodes 23 comprises, as described previously, a transparent conductive layer such as an ITO thin film or a NESA film, and a multilayered film of chromium-copper-chromium.

Then, a first dielectric layer 24 is formed on the glass substrate 22 so as to cover the display electrodes 23. The first dielectric layer 24 is formed by screen-printing a low-melting-point glass paste (softening point: about 580° C.), mainly comprising lead oxide (PbO), to a thickness of 25 μm, and drying and baking the same at about 590° C. so as to give a thickness of about 20 μm after baking. The opposite ends, serving as terminals of the display electrodes, may be covered initially with the dielectric layer, and the portions of the dielectric layer covering the electrode ends may be removed by etching after the sealing step. This permits prevention of oxidation of the electrode ends by heat during sealing.

Subsequently, as shown in FIG. 213, only the center portion of the first dielectric layer 24 is covered with a second dielectric layer 25, and a thin portion 24*a* serving as the bonding area of the sealing member is formed on the periphery of the first dielectric layer 24 not covered with the second dielectric layer. This second dielectric layer 25 also, as in the first dielectric layer 24, is formed by screen-printing a low-melting-point glass paste (softening pint: about 480° C.) mainly comprising PbO, and drying and baking (about 590° C.) the same into a thickness of 25 μm. The screen mask used in this step has on opening pattern different from that of the printing mask for the first dielectric layer.

As a result, the portion of the dielectric layer corresponding to the display region has thickness of 40 μm, and the thin portion 24*a* serving as the bonding area with the sealing member has thickness of 20 μm.

Subsequently, a protecting layer 26 comprising magnesium oxide (MgO) is formed by the vapor depositing process on the second dielectric layer 25, thus completing the manufacture of the front substrate 22.

Now, the fabrication steps of the back substrate 27 will be described. The process diagram is omitted, and the step will be described with reference to FIG. 2C illustrating the completed state.

First, a plurality of stripe-shaped address electrodes 28, each comprising a chromium-copper-chromium multilayered metal film, are formed by lithographic technology on a glass substrate 27 serving as a base material for the back substrate.

Then, a low-melting-point glass (softening point: about 580° C.) mainly comprising zinc oxide (ZnO) containing trace titanium oxide is screen-printed onto the glass substrate 27 including the address electrodes 28, and dried and baked (about 590° C.) to form a dielectric layer 29 having thickness of about 10 μm.

Then, a plurality of stripe-shaped barriers 30 having a height of about 150 μm, for partitioning the light emitting area, are formed in the center portion of the dielectric layer 29 corresponding to the display region. Each of the barriers 30 is formed by printing a low-melting-point glass paste (softening point: 580° C.) mainly comprising PbO, in a uniform thickness, substantially over the entire surface of the dielectric layer 29, drying the same, then cutting the dried layer by sand blast fabricating into a prescribed pattern, and baking the same at about 580° C.

Subsequently, RGB fluorescent pastes are screen-printed, or sequentially and repeatedly coated one by one by a dispenser, in long and narrow gaps between the individual barriers 30, and then dried and baked to complete forming.

Then, a continuous frame-shaped sealing member 32 is formed on the periphery of the dielectric layer 39. The sealing member 32 is formed by coating a low-melting-point glass paste (softening point: 400° C.), mainly comprising PbO, by means of a dispenser, drying the same, and prebaking the same at about 460° C. The sealing member solidifies after baking, and the height thereof is set so that the sealing member 32 is slightly higher than the barriers 30. The drying and the baking steps of the sealing member can be carried out simultaneously with those of the fluorescent members 31. The simultaneous execution of these steps is adopted in this embodiment for improving efficiency.

The front glass substrate 22 and the back glass substrate 27, having been subjected to the prescribed fabrication, are then placed one on top of the other as shown by arrows in FIG. 2C, and then, the discharge space is sealed between the substrates by heating and pressing the assembly.

The sealing step will now be described with reference to FIGS. 2C and 3.

Figure 3:
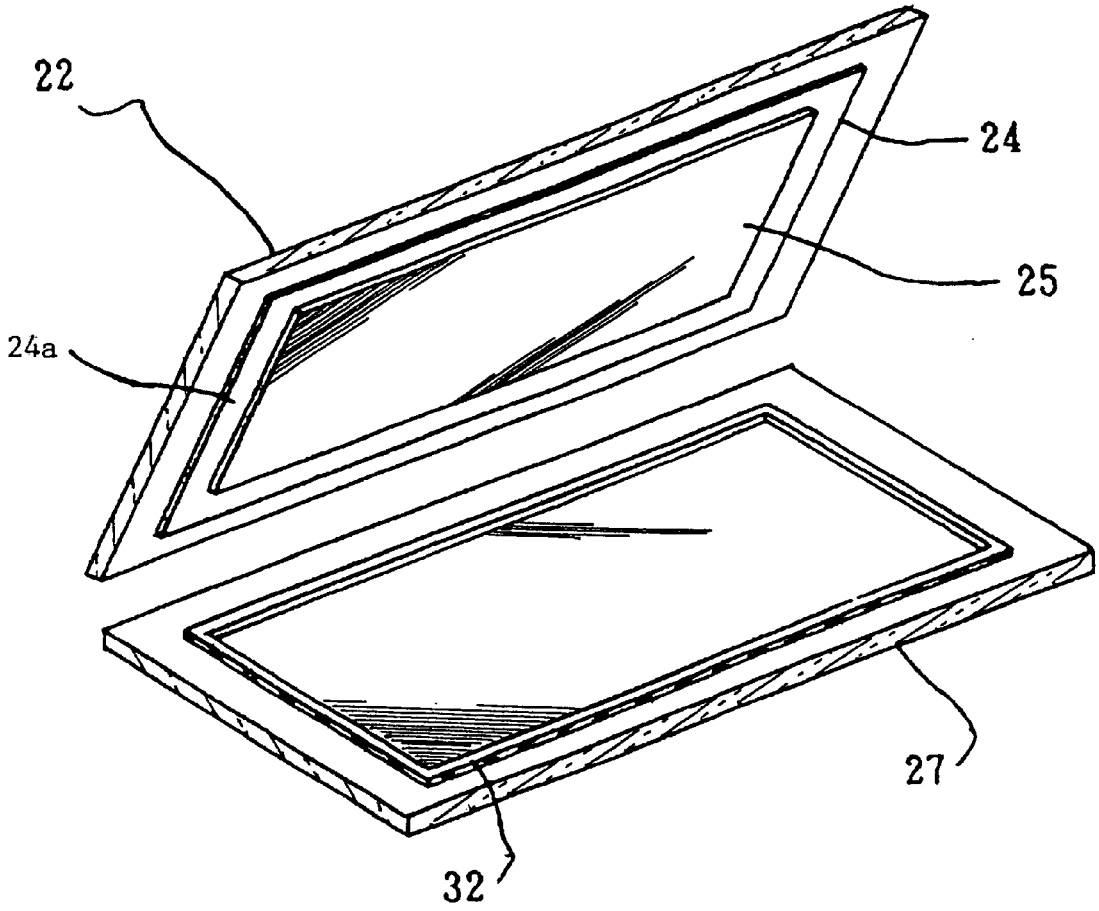
FIG. 3 is a perspective view for explaining the first embodiment of the PDP fabrication method of the invention.

FIG. 3 is a perspective view illustrating only the main portions of FIG. 2C: the shapes of the first dielectric layer 24, the second dielectric layer 25 and the sealing member 32 are shown for easier understanding.

More specifically, as described previously, the second dielectric layer 25 on the front glass substrate 22 covers the portion of the first dielectric layer 24 except for the periphery, and the portion where first dielectric layer 24 is exposed around the second dielectric layer 25 comprises the thin portion 24*a*. The sealing member 32 on the back glass substrate 27 is provided at a position on the dielectric layer opposite to the thin portion 24*a*.

The sealing process comprises the steps of placing the front glass substrate 22 and the back glass substrate 27 stacked with each other so as to align the thin portion 24*a* with the sealing member 32 and, then, heating the assembly to about 420° C. while applying prescribed pressure so that the substrates press against each other. The pressure is available by holding the substrate peripheries with clips having a spring property: in this pressed state, the sealing member softens to ensure adhesion and fixing of the pair of substrates.

As a result of this treatment, the sealing member 32 adheres to the thin portion 24*a* of the dielectric layer of the front glass substrate 22, thereby accomplishing sealing. While a partial force resulting from contact with the sealing member 32 acts on the thin portion 24*a* of the dielectric layer 24 during sealing, occurrence of cracks can be inhibited since the contact portion 24*a* is formed in a small thickness.

After completion of the sealing step as described above, the discharge space is evacuated and cleaned via a ventilating hole (not shown) communicating with the discharge space, and then, a discharge gas comprising a mixed gas of neon and xenon is sealed therein under a pressure of several hundred Torr. A PDP is completed by closing the ventilating hole.

In the above-mentioned embodiment, the dielectric layer on the front glass substrate 22 has a double-layer structure. The dielectric layer on the front glass substrate 22 may also have a structure of three or more layers, depending upon the thickness. For the formation thereof also, a method of forming comprising stacking a sheet-shaped dielectric material known as a green sheet (or green tape) is applicable, which can be replaced with the method of printing the low-melting-point glass paste.

The fabrication method of a second embodiment of the present invention will now be described. In this embodiment, a sealing member is previously formed on a dielectric layer on a front substrate, and sealing is effected by bonding it to a dielectric layer on a back substrate.

Figure 5A:
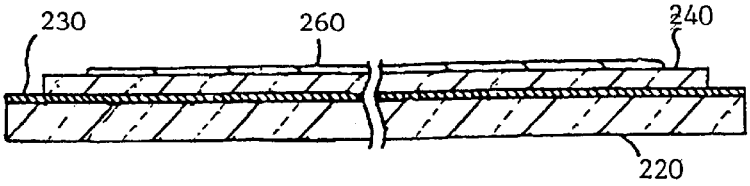
FIGS. 5A through 5C are sectional views for explaining the second embodiment of the PDP fabrication method of the invention.
Figure 5B:
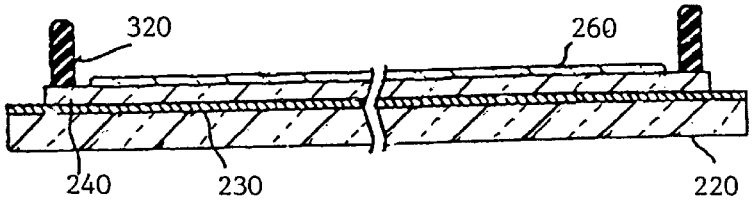
Figure 5C:
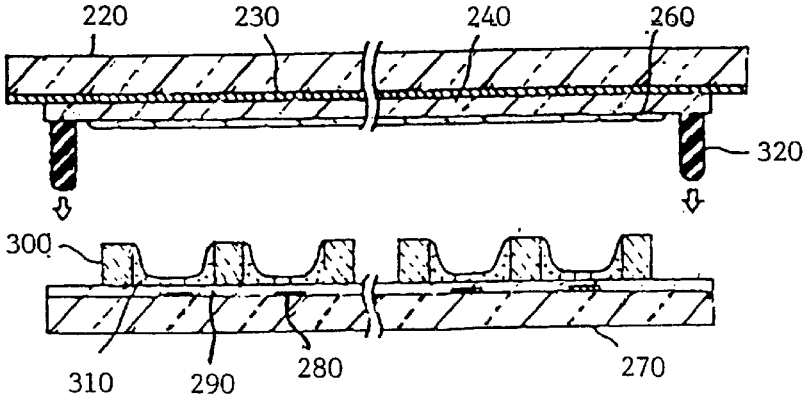
Figure 6:
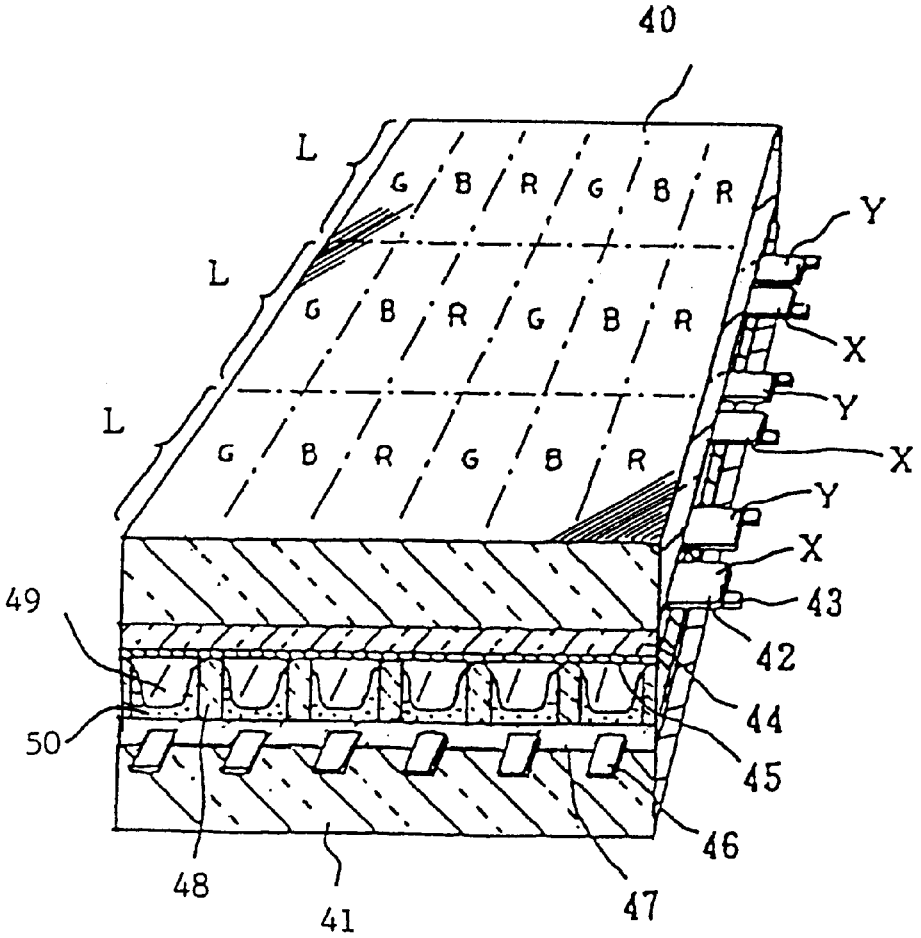
FIG. 6 PRIOR ART
FIG. 6 is a perspective view for explaining the structure of a conventional PDP.
Figure 7A:
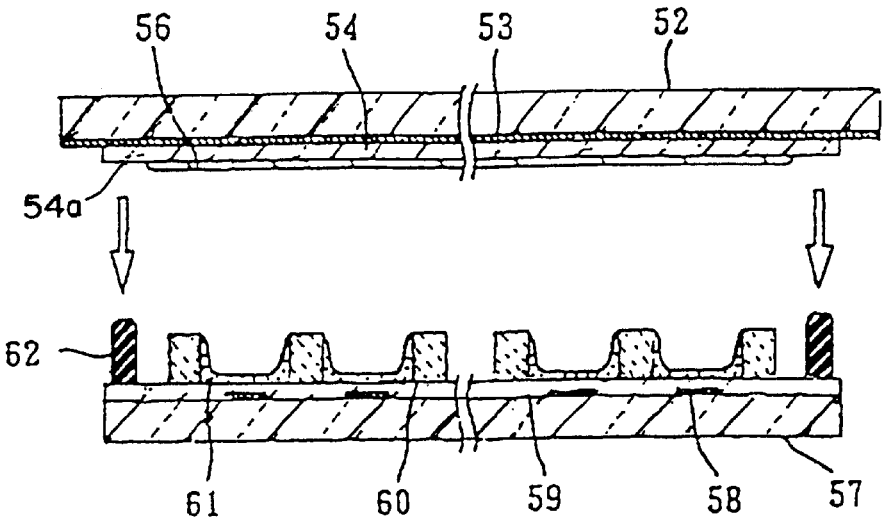
FIG. 7A PRIOR ART
FIGS. 7A and 7B are sectional views for explaining the conventional PDP and the fabrication method thereof.
Figure 7B:
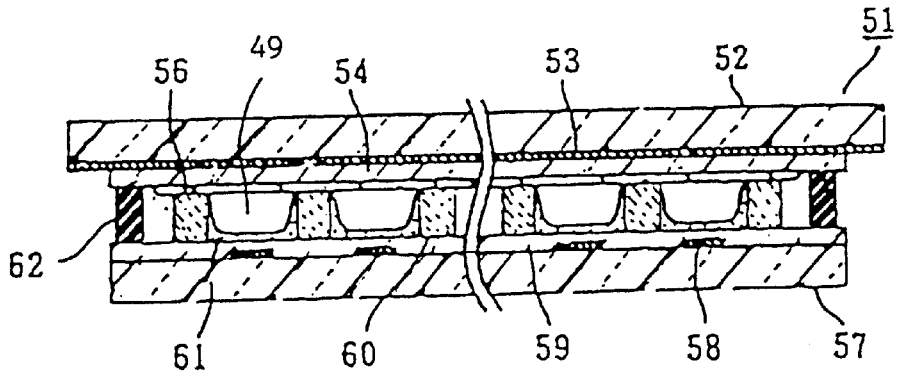
FIG. 7B PRIOR ART
Figure 8:
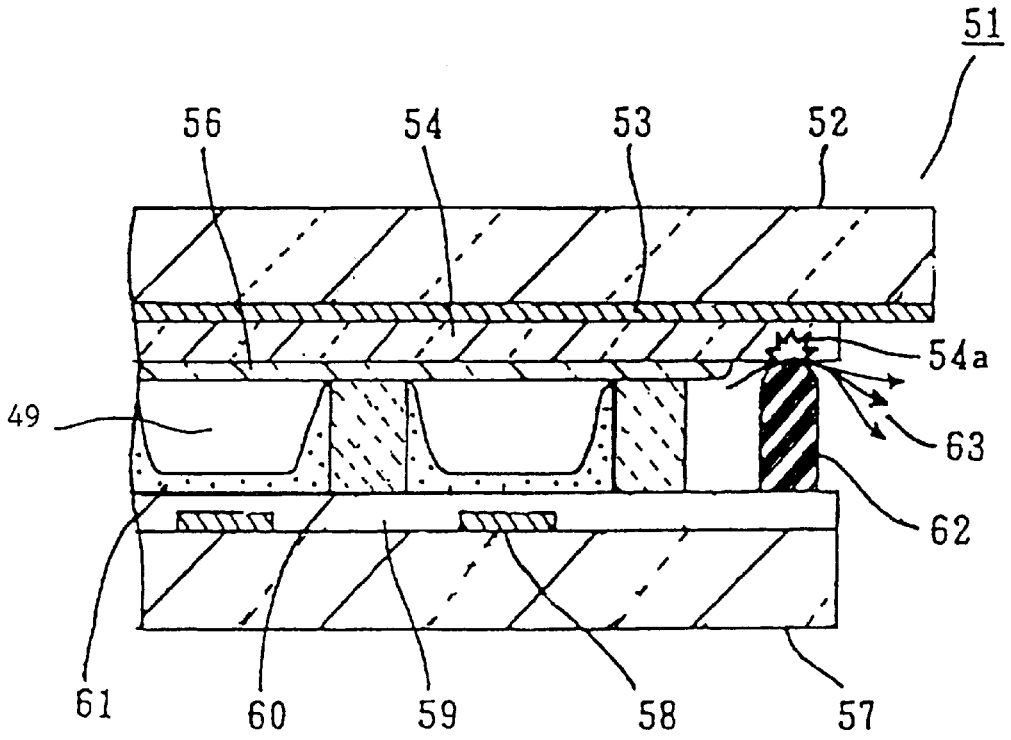
FIG. 8 PRIOR ART
FIG. 8 is a sectional view for explaining the problems in the conventional art.

FIGS. 5A through 5C are sectional views for explaining the fabrication method of the second embodiment: FIGS. 5A and 5B illustrate a step of fabricating the front substrate and FIG. 5C illustrates a stacking step of the front substrate and the back substrate. For the same steps as in the fabrication method of the first embodiment described above, the description is omitted here.

First, the fabrication process of the front substrate will be described.

As shown in FIG. 5A, a display electrode 230, a dielectric layer 240 and a protecting film 260 are sequentially formed on a front glass substrate 220. This step differs from that of the first embodiment in that the dielectric layer 240 is formed in a uniform thickness of about 40 μm as a whole. The dielectric layer is formed by a printing method of a low-melting-point glass paste mainly comprising PbO, or a method of stacking a sheet-shaped dielectric material so that only the opposite ends of the display electrode 230 are exposed.

Then, as shown in FIG. 5B, a frame-shaped sealing member 320 is formed on the periphery of the dielectric layer 240 not having a protecting film 260 formed thereon. Forming a sealing member 320 is another feature different from the first embodiment. As in the first embodiment, the sealing member 320 is formed by coating a low-melting-point glass paste by a dispenser, and drying and preliminarily baking the same. The front substrate is completed by these fabrication steps.

The fabrication process of the back substrate will now be described.

As in the first embodiment, an address electrode 280, a dielectric layer 290, barriers 300 and fluorescent members 310 are formed in this order on the back glass substrate 270. These components are quite the same as in the first embodiment, resulting in thickness of the dielectric layer 290 of about 10 $\mu$m. A difference from the first embodiment is that no sealing member is provided. FIG. 5C illustrates the state of completion.

After placing the front glass substrate 220 and the back glass substrate 270, having been subjected to the prescribed fabrication, one on top of the other as shown by arrows in FIG. 5C, sealing is effected through heating and pressing. At this point, the sealing member 320 is provided on the thicker dielectric layer 240 of the front glass substrate 270 and stacked so as to be in contact with the thinner dielectric layer 290 of the back glass substrate 270, resulting in no cracking of any of the dielectric layers of the substrates. That is, because a damage to the dielectric layer caused by the sealing member is larger on the contact side upon being stacked, the dielectric layer 240 having the sealing member 320 previously formed thereon is never damaged, and there is only a slight risk of damaging the dielectric layer 290 on the contact side because of a low stress resulting from the small thickness of 10 $\mu$m.

Upon completion of the sealing step as described above, as in the first embodiment, the discharge space is evacuated-and cleaned, and a discharge gas is sealed therein to complete the PDP. It should be noticed that, although used in the foregoing embodiments, the present invention is not limited to only a structure of a plasma display device having the discharge electrodes on one of opposing substrates and the address electrodes on the other, but instead also encompasses a plasma display device having both electrodes on only one of the substrates, such as is disclosed in U.S. Pat. No. 4,638,218, issued on Jan. 20, 1987, to T. Shinoda. et al. and is incorporated by reference herein.

According to the plasma display panel and the fabrication method thereof of the present invention, stacking can be effected while reducing the stress acting on the dielectric layer due to the sealing member. Even when forming a thick dielectric layer to reduce the power consumption, therefore, it is possible to ensure a sealing property without risk of failure resulting from occurrence of cracks in the dielectric layer.

What is claimed is:

1. A method of fabricating a plasma display panel of first and second substrates having corresponding surfaces in opposing relationship and defining a discharge space therebetween, a display region emitting light in a center of the panel and a peripheral region emitting no light in a periphery of the panel, the method comprising:

forming an array of discharge electrodes on the opposing surface of the first substrate;

forming a first dielectric layer on the opposing surface of the first substrate having the array of discharge electrodes thereon, the first dielectric layer comprising a central portion covering the array of discharge electrodes and a peripheral portion extending about the central portion, the peripheral portion being thinner than the central portion and defining a corresponding sealing portion on the opposing surface of the second substrate;

forming a sealing member on, and adhering the sealing member to, the sealing portion on the opposing surface of the second substrate;

juxtaposing said substrates with the sealing member therebetween so as to position a free edge of the sealing member in contact with the peripheral portion of the first dielectric layer; and heating the sealing member so as to melt and consequently adhere same to the peripheral portion of the first dielectric layer, sealing the discharge space therebetween.

2. The method of fabricating a plasma display panel according to claim 1, wherein the step of forming the first dielectric layer further comprises:

forming one dielectric layer on the opposing surface of the first substrate corresponding at least to the peripheral portion of the first dielectric layer; and forming another dielectric layer on the opposing surface of the first substrate corresponding to the central portion of the first dielectric layer, the sequence of forming the one and the another dielectric layers being interchangeable.

3. The method of fabricating a plasma display panel according to claim 2, wherein each of the one and the another dielectric layers is formed by printing a dielectric paste separately on the opposing surface of the first substrate.

4. The method of fabricating a plasma display panel according to claim 2, wherein the one and the another dielectric layers are formed by sealing respective dielectric sheets separately on the opposing surface of the first substrate.

5. The method of fabricating a plasma display panel according to claim 2, wherein the one and the another dielectric layers are made of soldering glass having a low softening temperature and a main component of which is lead oxide (PbO).

6. The method of fabricating a plasma display panel according to claim 1, further comprising:

forming an array of addressing electrodes on the surface of the second substrate opposing the surface of the first substrate having the array of discharge electrodes thereon; and forming a second dielectric layer on the opposing surface of the second substrate having the array of addressing electrodes thereon, wherein the sealing member adheres to each of the first and second dielectric layers in respective peripheral portions thereof, to provide air-tight sealing between the first and second substrates.

7. A method for fabricating an AC memory type plasma display panel of a pair of substrates with respective arrays of electrodes formed on corresponding, opposing surfaces of the substrates, the opposing surfaces of the substrates defining a discharge space for generating a gas plasma between the substrates, the method comprising:

forming respective dielectric layers on the corresponding, opposing surfaces of the pair of substrates, a sealing portion at the periphery of one dielectric layer, surrounding a display region thereof, being thinner than a thickness of a portion of the one dielectric layer covering the display region and thinner than a thickness of a sealing portion of the other dielectric layer formed on the corresponding, opposing surface of the other substrate;

forming a sealing member on the relatively thicker sealing portion of the other dielectric layer;

juxtaposing the substrates with a free edge of the sealing member contacting the thinner sealing portion of the one dielectric layer; and heating at least the sealing member so as to melt and consequently adhere same to the sealing portion of the one dielectric layer to afford an air-tight seal of the discharge space between the substrates.

8. The method for fabricating an AC memory type plasma display panel according to claim 7, wherein the electrodes formed on the other substrate comprise surface discharge electrodes which generate a gas plasma in the discharging space and the electrodes covered with the one dielectric layer are addressing electrodes which control an address at which a surface plasma discharge takes place.

9. A method of fabricating a plasma display panel of spaced substrates and having a display region for emitting light in a center of the panel and a peripheral region for emitting no light in a periphery of the panel, comprising:

forming respective arrays of electrodes on corresponding, opposing surfaces of the substrates;

forming respective dielectric layers on the corresponding, opposing surfaces, each having a central portion covering the respective array of electrodes formed on the corresponding, opposing surface and a peripheral portion surrounding the central portion;

sealing the spaced substrates to each other by a sealing member which extends between, and is sealed at opposite edges to, corresponding peripheral portions of the respective dielectric layers, so as to extend about and define a discharge space between the corresponding opposing surfaces of the pair of spaced substrates in which a gas plasma is generated, the sealing member being formed on one of said dielectric layers at the corresponding peripheral portion thereof and having a free edge extending to the corresponding peripheral portion of the other dielectric layer and adhered thereto by heat and pressure, thereby sealing the pair of opposing substrates to each other, the sealing portion of the one of the dielectric layers on which the sealing member is formed being relatively thicker and the sealing portion of the other of the dielectric layers to which the free end extends and is adhered being relatively thinner.

10. The method of fabricating a plasma display panel according to claim 9, further comprising forming the relatively thicker sealing portion of the one dielectric layer of a thickness in a range of up to 40 $\mu$m and forming the relatively thinner sealing portion of the other dielectric layer of a thickness in a range of from 5 $\mu$m to 35 $\mu$m.

11. The method of fabricating a plasma display panel according to claim 9, further comprising forming the one dielectric layer on the corresponding, opposing surface of the substrate on which the array of discharge electrodes is formed and forming the other dielectric layer on the corresponding surface of the opposing substrate on which an array of display electrodes is formed.

12. A method of fabricating a plasma display panel, of first and second substrates having corresponding, opposing surfaces defining a discharge space therebetween, having a display region in a center of the panel and a peripheral region, surrounding the display region, in which no light is emitted, comprising:

forming an array of discharge electrodes on one of the opposing surfaces;

forming first and second dielectric layers on the corresponding, opposing surfaces of the first and second substrates, respectively, each dielectric layer comprising a central portion corresponding to the display region and a peripheral portion surrounding the central portion thereof and corresponding to the peripheral region of the plasma display panel; and forming a sealing member extending between the respective peripheral portions of the first and second dielectric layers, the sealing member being formed on the peripheral portion of one of the first and second dielectric layers and having a free edge adhered by heat and pressure to the peripheral portion of the other of the first and second dielectric layers, the peripheral portion to which the free edge is adhered being of a smaller thickness than the peripheral portion on which the sealing member is formed.

13. A method of fabricating a plasma display panel according to claim 12, wherein the peripheral portion of the larger thickness is in the range of up to 40 $\mu$m.

14. A method of fabricating a plasma display panel according to claim 13, wherein the peripheral portion of the smaller thickness is in the range of up to 20 $\mu$m.

15. A method of fabricating a plasma display panel of first and second substrates having corresponding, opposing surfaces defining discharge spaces therebetween and having a display region in a center of the panel, in which light is emitted, and a peripheral region in a periphery of the panel, in which no light is emitted, comprising:

forming an array of discharge electrodes on corresponding, opposing surface of one of the first and second substrates;

forming first and second dielectric layers on the corresponding, opposing surfaces of the first and second substrates, respectively, each dielectric layer comprising a central portion corresponding to the display region and a peripheral portion corresponding to the peripheral region of the plasma display panel;

forming a sealing member on the peripheral portion of one of the first and second dielectric layers and having a free edge; and adhering the free edge of the sealing member, by heat and pressure, to a bonding portion of the peripheral portion of the other of the first and second dielectric layers, the bonding portion of the peripheral portion of the other dielectric layer to which the free edge is adhered by heat and pressure being of a smaller thickness than the respective thicknesses of the central portion of the one dielectric layer and of at least the peripheral portion of the other dielectric layer.

16. A method of fabricating a plasma display panel according to claim 15, further comprising forming the peripheral portion of the one of the first and second dielectric layers of a thickness in a range of up to 40 $\mu$m and forming the bonding portion of the peripheral portion of the other dielectric layer of a thickness in a range from 5 $\mu$m to 35 $\mu$m.

17. A method of fabricating a plasma display panel according to claim 15, further comprising forming the central portion of the one of the first and second dielectric layers from which light is emitted in a thickness of several tens of microns.

* * * * *